US011096464B2

(12) United States Patent
Shami

(10) Patent No.: US 11,096,464 B2
(45) Date of Patent: Aug. 24, 2021

(54) HAIR STYLING FLAT IRON

(71) Applicant: FAROUK SYSTEMS, INC., Houston, TX (US)

(72) Inventor: Farouk M. Shami, Houston, TX (US)

(73) Assignee: FAROUK SYSTEMS, INC., Houston, TX (US)

( * ) Notice: Subject to any disclaimer, the term of this patent is extended or adjusted under 35 U.S.C. 154(b) by 241 days.

(21) Appl. No.: 15/774,840

(22) PCT Filed: Dec. 21, 2017

(86) PCT No.: PCT/US2017/067997
§ 371 (c)(1),
(2) Date: May 9, 2018

(87) PCT Pub. No.: WO2019/125476
PCT Pub. Date: Jun. 27, 2019

(65) Prior Publication Data

US 2020/0268120 A1 Aug. 27, 2020

(51) Int. Cl.
*A45D 1/04* (2006.01)
*A45D 2/00* (2006.01)
*A45D 1/00* (2006.01)

(52) U.S. Cl.
CPC ..... *A45D 1/04* (2013.01); *A45D 2/001* (2013.01); *A45D 2001/004* (2013.01); *A45D 2200/20* (2013.01)

(58) Field of Classification Search
CPC ... A45D 2/00; A45D 1/04; A45D 1/06; A45D 1/14; A45D 1/28; A45D 2/40; A45D 7/02
(Continued)

(56) References Cited

U.S. PATENT DOCUMENTS 8,233,784 B2 7/2012 Zenteno et al.
8,530,794 B2 9/2013 Shami et al.
(Continued)

FOREIGN PATENT DOCUMENTS

CN 101084614 A 12/2007
CN 20090070306 A 7/2009
(Continued)

OTHER PUBLICATIONS

EP Search Report received in co-pending EP Application No. 17858487, dated Sep. 28, 2018, 8 pages.
(Continued)

*Primary Examiner* — Nicholas D Lucchesi
(74) *Attorney, Agent, or Firm* — Blank Rome LLP

(57) ABSTRACT

A hairstyling flat iron includes a first arm having a first gripping portion and a first styling portion; a second arm having a second gripping portion and a second styling portion; a biasing member coupled with the first gripping portion and the second gripping portion to move the second arm relative to the first arm; a first heat heating plate located on the first styling portion and facing the second arm, the first heating plate having a first heat transmissive plate and a first coating disposed on the first heat transmissive plate, the first coating having ceramic and lava rock incorporated therein; and a second heat heating plate located on the second styling portion and facing the first arm, the second heating plate having a second heat transmissive plate and a second coating disposed on the second heat transmissive plate, the second coating having ceramic and lava rock incorporated therein.

22 Claims, 4 Drawing Sheets

(58) Field of Classification Search
USPC ..... 132/211, 224, 269, 271
See application file for complete search history.

(56) References Cited

U.S. PATENT DOCUMENTS

| | | | | |
|---|---|---|---|---|
| 8,789,539 | B2 * | 7/2014 | Linglin | A45D 1/04 132/224 |
| 8,967,159 | B1 * | 3/2015 | Jenkins | A45D 2/001 132/223 |
| 9,149,102 | B2 * | 10/2015 | Fereyre | A45D 2/00 |
| 9,713,369 | B2 * | 7/2017 | Washington | A45D 2/001 |
| 2005/0056631 | A1 | 3/2005 | Cha | |
| 2007/0119844 | A1 | 5/2007 | Lo et al. | |
| 2007/0203431 | A1 * | 8/2007 | Leta | A61F 7/0053 601/2 |
| 2011/0226277 | A1 | 9/2011 | Choi | |
| 2012/0227758 | A1 | 9/2012 | Ford et al. | |
| 2012/0291797 | A1 | 11/2012 | Degrood et al. | |
| 2015/0335120 | A1 | 11/2015 | Moore et al. | |
| 2016/0360846 | A1 | 12/2016 | Shami | |

FOREIGN PATENT DOCUMENTS

| | | | |
|---|---|---|---|
| CN | 104411203 | A | 3/2015 |
| EP | 2238855 | A1 | 10/2010 |
| JP | 3078424 | U | 7/2001 |
| JP | 2004105577 | A | 4/2004 |
| KR | 1020020014112 | A | 2/2002 |
| KR | 200328335 | Y1 | 9/2003 |
| KR | 1020050108799 | A | 11/2005 |
| KR | 1020170103282 | A | 9/2017 |
| WO | 2015028632 | A1 | 3/2015 |

OTHER PUBLICATIONS

PCT Search Report received in co-pending PCT Application No. PCT/US2017/067997, dated Feb. 22, 2018, 15 pages.

"Chi Man Innovates Again with New Chi Lava 1" Hairstyling Iron," Beauty Launchpad, dated Nov. 30, 2017, 4 pages.

"Overview of Pelonis Technologies" Honeycomb PTC Air Heater Products. Retrieved from http://www.pelonistechnologies.com (Aug. 25, 2020) 11 pages.

"Generic 1 Pcs PTC 50W 12V AC/DC Heater Automatic Thermostat with Stand Corrugated Strip Small Space Heating Tools." Retrieved from https://www.amazon.com.in/Generic-Automatic-Thermostat-Corrugated-Heating/dp/B073JJLZ2X (Jun. 30, 2017) 2 pages.

* cited by examiner

HAIR STYLING FLAT IRON

FIELD OF THE INVENTION

The present invention relates to a hair styling flat iron. The present invention further relates to a hair styling flat iron having heating plates comprising a composition having volcanic or lava rock and a ceramic. The present invention further relates to methods of making a heating plate for a hair styling flat iron where the heating plate is made in part of volcanic or lava rock and a ceramic.

BACKGROUND OF THE INVENTION

Hair styling flat irons typically include two handles or arms, pivotably hinged at one end. Each handle includes a gripping portion on the outer side of the handle and extending from the hinged end to a middle portion of the flat iron for gripping by a user. Each handle further includes a heating plate located on the inner side of the handle and extending longitudinally from the middle portion of the handle to or near the end of the handle opposite the hinged end. The heating plates are usually made of a metal, an alloy or a ceramic. Heating plates made of ceramic are preferred as those made of a metal or an alloy are generally less gentle to hair. An electric heating element is located beneath each heating plate is utilized to warm the heating plate to a predetermined temperature which can be set by a digital or analog temperature controller located on one of handles. After the flat iron is heated to a desired or working temperature, the heating plates are positioned above and below strands of hair to be styled and the hinged handles are closed toward each other, bringing the heating plates in contact with the strands of hair. The handles are then moved relative to the strands of hair, so as to run the heating plates along the strands of hair until they exit from between the heating plates.

DETAILED DESCRIPTION

Figure 1:
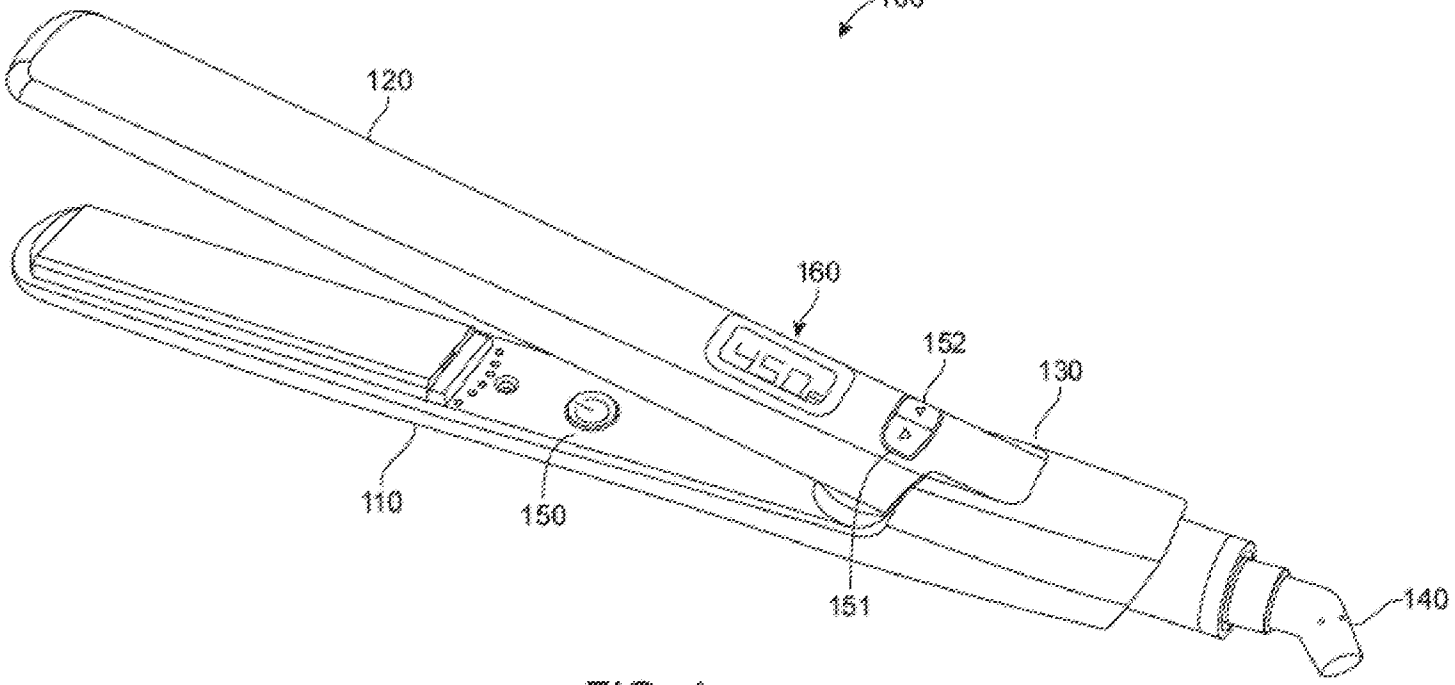
FIG. 1 is a perspective view of a hair styling flat iron in accordance with various aspects of the present disclosure.

The following description of the embodiments is merely exemplary in nature and is in no way intended to limit the subject matter of the present disclosure, their application, or uses.

As used throughout, ranges are used as shorthand for describing each and every value that is within the range. Any value within the range can be selected as the terminus of the range. Unless otherwise specified, all percentages and amounts expressed herein and elsewhere in the specification should be understood to refer to percentages by weight.

For the purposes of this specification and appended claims, unless otherwise indicated, all numbers expressing quantities, percentages or proportions, and other numerical values used in the specification and claims, are to be understood as being modified in all instances by the term "about." The use of the term "about" applies to all numeric values, whether or not explicitly indicated. This term generally refers to a range of numbers that one of ordinary skill in the art would consider as a reasonable amount of deviation to the recited numeric values (i.e., having the equivalent function or result). For example, this term can be construed as including a deviation of ±10 percent, alternatively ±5 percent, and alternatively ±1 percent of the given numeric value provided such a deviation does not alter the end function or result of the value. Accordingly, unless indicated to the contrary, the numerical parameters set forth in this specification and attached claims are approximations that can vary depending upon the desired properties sought to be obtained by the present invention.

It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items. For example, as used in this specification and the following claims, the terms "comprise" (as well as forms, derivatives, or variations thereof, such as "comprising" and "comprises"), "include" (as well as forms, derivatives, or variations thereof, such as "including" and "includes") and "has" (as well as forms, derivatives, or variations thereof, such as "having" and "have") are inclusive (i.e., open-ended) and do not exclude additional elements or steps. Accordingly, these terms are intended to not only cover the recited element(s) or step(s), but may also include other elements or steps not expressly recited. Furthermore, as used herein, the use of the terms "a" or "an" when used in conjunction with an element may mean "one," but it is also consistent with the meaning of "one or more," "at least one," and "one or more than one." Therefore, an element preceded by "a" or "an" does not, without more constraints, preclude the existence of additional identical elements.

For the purposes of this specification and appended claims, the term "coupled" refers to the linking or connection of two objects. The coupling can be permanent or reversible. The coupling can be direct or indirect. An indirect coupling includes connecting two objects through one or more intermediary objects. The term "substantially" refers to an element essentially conforming to the particular dimension, shape or other word that substantially modifies, such that the component need not be exact. For example, substantially circular means that the object resembles a circle, but can have one or more deviations from a true circle.

The disclosure is directed to hair styling flat irons. Hair styling flat irons in accordance with various aspects of the present disclosure comprise heat transmissive plates coated with a composition comprising volcanic or lava rock. Hair styling flat irons in accordance with various embodiments of the present disclosure exhibit superior properties in use as compared to prior art flat irons due to the incorporation of volcanic or lava rock into a ceramic-containing layer on exterior surfaces of the heat transmissive plates of flat irons. Specifically, hair styling flat irons in accordance with various aspects of the preset disclosure have been found to exhibit properties far superior to prior art flat irons such as better heat retention, faster rates of heating before use, and faster rates of reheating during use. Hair styling flat irons according to the present disclosure are also operable over a wide temperature range. Specifically, in preferred embodiments, hair styling flat irons of the present disclosure are operable at temperatures ranging from about 200° F. (−93° C.) to about 450° F. (−232° C.).

Figure 2:
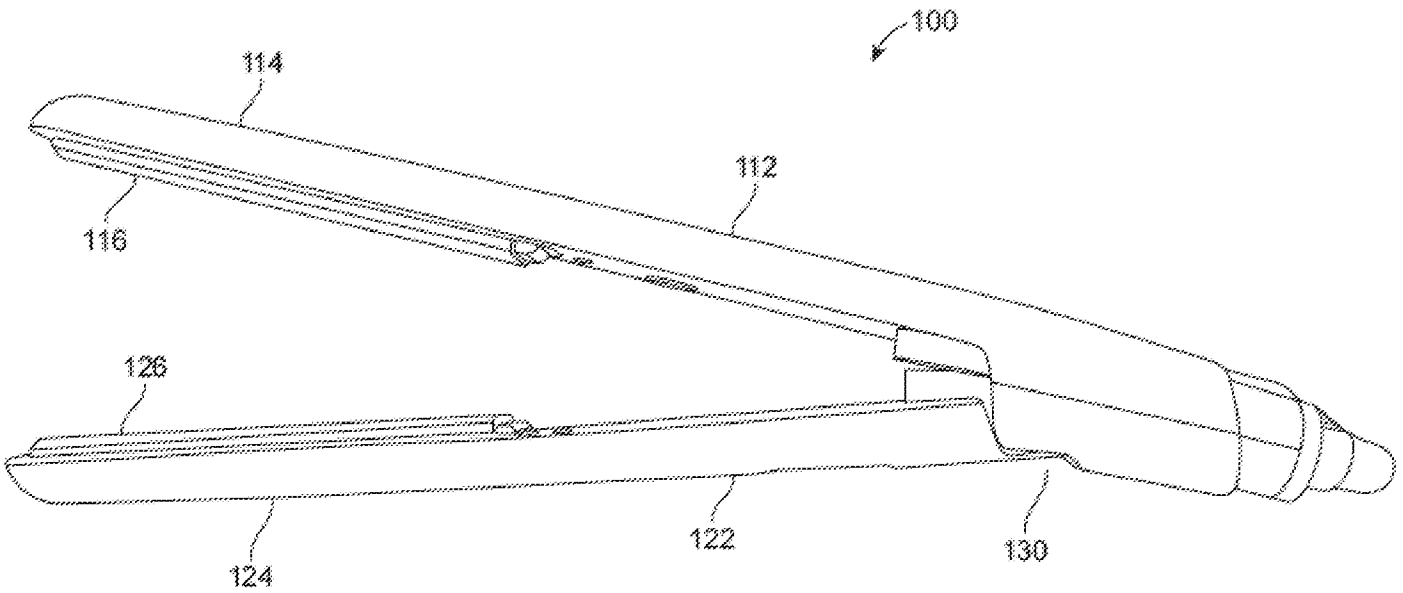
FIG. 2 is a side plan view of the flat iron of FIG. 1 in accordance with various aspects of the present disclosure.

FIG. 1 is a perspective view of a hair styling flat iron in accordance with various aspects of the present disclosure. FIG. 2 a side plan view of the flat iron of FIG. 1 in accordance with various aspects of the present disclosure. The flat iron 100 includes first arm 110, and a second arm 120 coupled with each other via a pivotable hinge 130. In some instances, the pivotable hinge 130 can include a spring assembly to bias the second arm 120 away from the first arm 110 such that the first arm 110 and the second arm 120 are in an open position. In some instances, the flat iron 100 can include a locking element (not shown) to keep the flat iron in a closed position.

Each arm includes a handle portion 112, 122 and a styling portion 114, 124. Each styling portion 114, 124 includes a heating plate 116, 126 located on an interior portion thereof. The heating plates 116, 126 are positioned on opposed interior surfaces of the first arm 110 and the second arm 120, such that the heating plates 116, 126 are generally aligned and abut when the first arm 110 and the second arm 120 are in a closed position. Electricity, in the form of alternating or direct current, may be provided to the flat iron 100 via an electrical cord 140 from a conventional external electricity source, where the electrical cord 140 is electrically couplable with the external electricity source. In some instances, the electrical cord 140 can be omitted and power can be supplied to the flat iron 100 by an internal power source such as one or more single-use or rechargeable batteries. One or more dials or buttons 150, 151, 152 may be used to turn on/off the flat iron 100 and to vary the temperature of the heating plates 116, 126. The temperature of the heating plates 116, 126 at any given moment can be viewed via a display 160.

When the flat iron 100 is in an open position, the first arm 110 and the second arm 120 are positioned such that the heating plates 116, 126 are spaced apart. An open position allows a user to insert hair between the plates 116, 126 to be styled. To move the first arm 110 and the second arm 120 to the closed position, the user applies a clamping pressure to the first and second arms 110, 120 to move the styling portion 124 of the second arm 120 in a pivoting motion toward the styling portion 114 of the first arm 110. When the flat iron 100 is in a closed position, the lava-rock heating plates 116, 126 of the first and second arms 110, 120 are in abutting relation to each other to style, and in particular, straighten the hair captured therebetween. In a closed position, no additional hair can be inserted between the plates 116, 126.

As illustrated by FIGS. 1-2, the heating plates 116, 126 can be described as having substantially flat surfaces. In some instances, the heating plates 116, 126 can have convex surfaces. In other instances, the surfaces of the heating plates 116, 126 can be knobbed, ribbed, grooved, or wavy, can have spike or pyramid-shaped protrusions, or can be otherwise textured. In other instances, the surfaces of the heating plates 116, 126 can have a series of blades extending along the width of the heating plates 116, 126, each blade being triangular prismatic, rectangular, circular, semi-circular, convex or concave.

Each of the heating plates 116, 126 include a heat transmissive plate and a coating comprising volcanic or lava rock and a ceramic ("lava rock coating") on the external surface of the heat transmissive plate. In some instances, each of the heating plates 116, 126 further include a protective coating on the lava rock coating.

In some instances, the heat transmissive plates are made of a metal such as aluminum, iron or copper. In other instances, the heat transmissive plates can be made of an alloy such as steel, brass, bronze, a Hastelloy® alloy such as a nickel-chromium-molybdenum-tungsten, nickel-chromium-molybdenum-tungsten-iron, nickel-chromium-cobalt, an Inconoly® alloy such as iron-nickel-chromium or iron-nickel-chromium, an austentic nickel-chromium-based alloy (Inconel), a nickel-copper alloy (Monel), or a cupronickel alloy. In yet other instances, the heat transmissive plates can be made of a porcelain or ceramic such as silicon carbide, aluminum nitride, silicon nitride, alumina ($Al_2O_3$), beryllium oxide (BeO), boron nitride (BN), and titania ($TiO_2$).

The lava rock of the lava rock coating can comprise sodium oxide ($Na_2O$) and potassium oxide ($K_2O$), ranging between 0 and 16 wt % in total of the lava rock. The lava rock can comprise silicon oxide ($SiO_2$) and be described as ultramafic (i.e., having <45 wt % $SiO_2$), mafic (45-52 wt % $SiO_2$), intermediate (52-63 wt % $SiO_2$), intermediate-felsic (63-69 wt % $SiO_2$), or felsic (>69 wt % $SiO_2$). Specific examples of lava rock used in lava rock coatings on heat transmissive plates include, but are not limited to, komatiite, picrite basalt, basalt, basaltic andesite, andesite, dacite, rhyolite, nephelinite, melilitite, tephrite, basanite, trachybasalt, basaltic trachyandesite, trachyandesite, trachite, trachydacite, phonotephrite, tephriphonolite, phonolite, scoria, tuff, latite pumice, and ignimbrite. The ceramic of the lava rock coating can be any suitable ceramic. In some instances, the ceramic of the lava rock coating can be any one of silicon carbide, aluminum nitride, silicon nitride, alumina ($Al_2O_3$), beryllium oxide (BeO), boron nitride (BN), and titania ($TiO_2$).

The lava rock coating can have a thickness ranging from about 5 micrometers (μm) to about 100 μm, alternatively from about 10 μm to about 75 μm, alternatively from about 15 μm to about 50 μm, alternatively from about 20 μm to about 40 μm, alternatively from about 20 μm to about 30 μm, and alternatively about 25 μm.

In some instances, the lava rock coating is composed of only a resin having ceramic and lava rock dispersed therein. Preferably, the ceramic and lava rock are homogenously dispersed in the resin. When the resin is only made up of only lava rock, ceramic and a resin, the lava rock coating can have between about 0.1 wt % to about 25 wt % lava rock, alternatively about 0.5 wt % to about 20 wt % lava rock, alternatively about 1 wt % to about 15 wt % lava rock, alternatively about 1.5 wt % to about 10 wt % lava rock, alternatively about 2 wt % to about 5 wt % lava rock, and alternatively about 2.5 wt % to about 3.5 wt % lava rock; and between about 0.1 wt % to about 25 wt % ceramic, alternatively about 0.5 wt % to about 20 wt % ceramic, alternatively about 1 wt % to about 15 wt % ceramic, alternatively about 1.5 wt % to about 10 wt % ceramic, alternatively about 2 wt % to about 5 wt % ceramic, and alternatively about 2.5 wt % to about 3.5 wt % ceramic. In any of the above instances, the remainder of the lava rock coating will be the resin.

In some instances, in addition to a resin, ceramic and lava rock, the lava rock coating can further include some or all of one or more pigments, one or more fillers, one or more surfactants, and tourmaline. When pigments and fillers are present, they can comprise between about 10 wt % and about 33 wt % of the lava rock coating. When one or more surfactants are present, they can comprise between about 0.0125 wt % and 6.25 wt % of the lava rock coating. When tourmaline is present, it can comprise between about 1 wt % and about 3 wt % of the lava rock coating.

The resin of the lava rock coating can be any suitable resin including, but not limited to, a polyphenylene sulfide (PPS) resin having a mass average molecular weight (Mw) of 35,000 or more; a silicon-carboxyl resin, a monoaluminum phosphate resin, an alumina silicate resin; a silicone epoxy resin, a polyimide resin, a polysilazane resin such as a perhydropolysilazane, a methylhydridocyclositazane, an alkylhydridocyclosilazane, and a polyureidosilazane, a polysiloxane, a polyalkylsesquioxane resin, such as a polymethylsilsesquioxane, a polyvinylsilsequioxane, and a polyphenylsilsesquioxane, a polyphosphazine, a polyborosilane, a polycarbosilazane, a methylpolycarbosilane, a vinylpolycarbosilane, a methylvinylpolycarbosilane, a polytitanocarbosilane, an allyl hydridopolycarbosilane, a hydridopolycarbosilane, a ureamethylvinylsilazane, a polyvinylsiloxane, a polymethylsiloxane, a polydimethylsiloxane, a polycarbosilane, variants, derivatives and combinations thereof.

The protective coating can be made of any suitable material that is stable at operating temperatures of hairstyling flat irons in accordance with various aspects of the present disclosure. In some instances, the protective coating is made of silicon dioxide. In other instances, the protective coating can be made of a metal oxide such as titanium dioxide or aluminum oxide. The protective coating can be applied to have a thickness ranging from about 100 nm to about 50 μm, alternatively about 500 nm to about 40 μm, alternatively about 1 μm to about 30 μm, alternatively about 2.5 μm to about 20 μm, and alternatively about 5 μm to about 10 μm.

The hairstyling flat iron 100 can have an operational temperature (that is, can be configured to heat the heating plates 116, 126 to a temperature) ranging from room temperature to about 600° F., alternatively about 100° F. to about 500° F., alternatively about 150° F. to about 500° F., and alternatively from about 200° F. to about 450° F.

Figure 3:
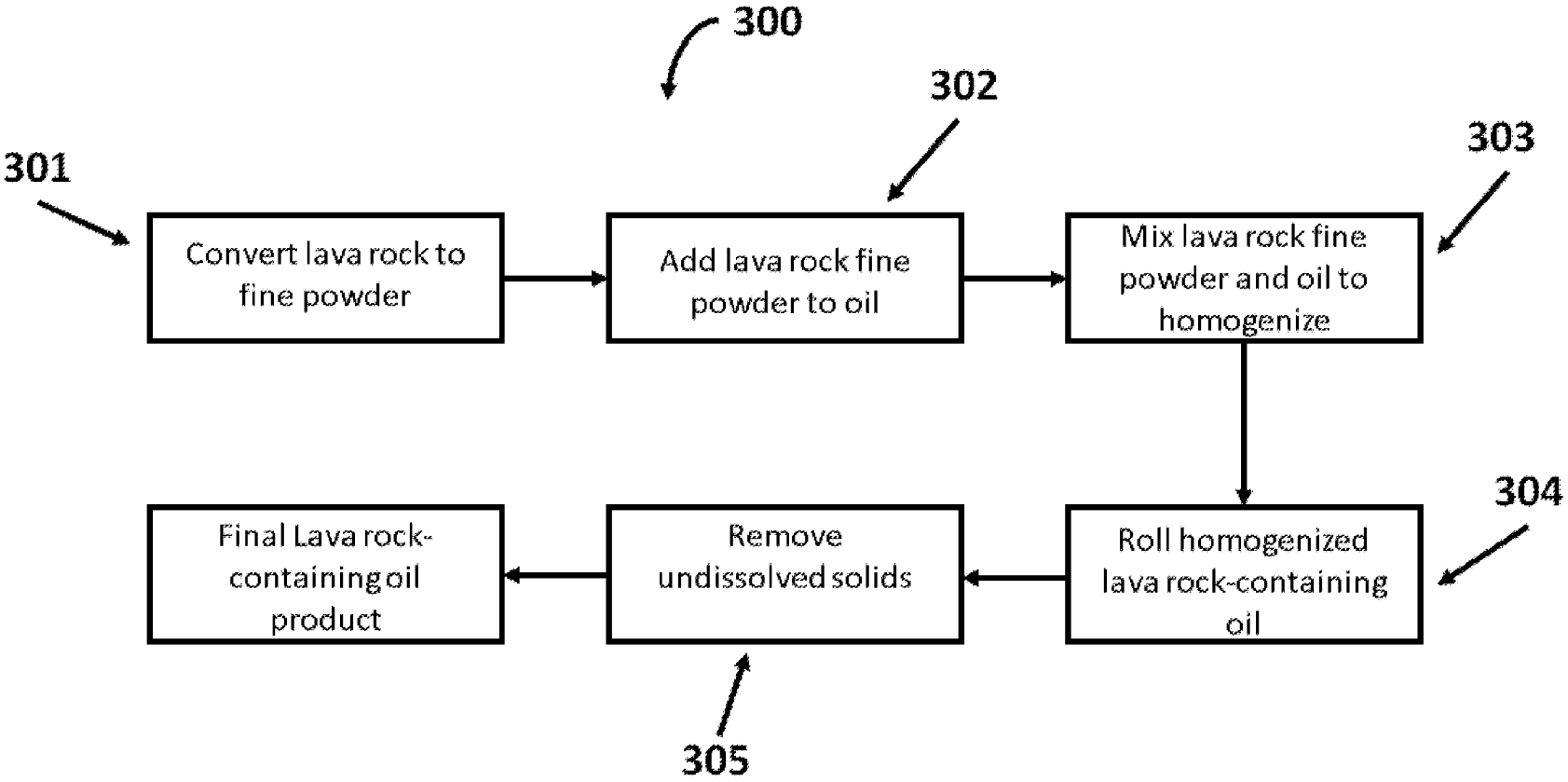
FIG. 3 is a flowchart illustrating an exemplary method of forming a lava rock-containing oil an in accordance with various aspects of the present disclosure.

FIG. 3 is a flow chart illustrating an exemplary method for preparing a lava rock-containing ceramic oil. One of ordinary skill in the art will appreciate that one or more steps of the exemplary method 300 can be omitted, or one or more steps can be added to the exemplary method 300, without imparting from the scope of the present disclosure. The exemplary method 300 can start at block 301. In block 301, a lava rock is converted to a fine powder. The lava rock can be of any type which is capable of being ground into a fine powder. The lava rock can be composed in part of sodium oxide ($Na_2O$) and potassium oxide ($K_2O$), ranging between 0 and 16 wt % in total of the lava rock. The lava rock can also be composed in part of silicon oxide ($SiO_2$) and be described as ultramafic (i.e., having <45 wt % $SiO_2$), mafic (45-52 wt % $SiO_2$), intermediate (52-63 wt % $SiO_2$), intermediate-felsic (63-69 wt % $SiO_2$), or felsic (>69 wt % $SiO_2$). Specific examples of lava rock used in accordance with various aspects of the present disclosure include, but are not limited to, komatiite, picrite basalt, basalt, basaltic andesite, andesite, dacite, rhyolite, nephelinite, melilitite, tephrite, basanite, trachybasalt, basaltic trachyandesite, trachyandesite, trachite, trachydacite, phonotephrite, tephriphonolite, phonolite, scoria, tuff, latite pumice, and ignimbrite.

The lava rock can be converted to fine powder by any conventional means known to one of ordinary skill in the art such as a ball mill, a tube mill, a ring and ball mill, a bowl mill, a vertical spindle roller mill, a demolition pulverizer, an impact pulverizer, a rock crusher, a chain hammer rock crusher/pulverizer, etc. Upon conversion, the fine powder can consist of lava rock particulates having diameters ranging from about 10 nm to about 25 μm, alternatively from about 10 nm to about 20 μm, alternatively from about 10 nm to about 15 μm, alternatively from about 10 nm to about 10 μm, alternatively from about 10 nm to about 5 μm, alternatively from about 50 nm to about 5 μm, and alternatively from about 100 nm to about 5 μm.

In block 302, the powdered lava rock is then incorporated into a ceramic oil to form a lava rock-containing oil. The ceramic oil can be any suitable coating composition which comprises a ceramic. In some instances, ceramic oils used in accordance with varying aspects of the present disclosure include a ceramic dispersed in a resin. In some instances, ceramic oils used in accordance with varying aspects of the present disclosure include a ceramic-containing resin, one or more color pigments, fillers, water, one or more surfactants and tourmaline. In some instances, the ceramic oil can contain about 30 to about 60 wt % of a ceramic-containing resin, about 10 to about 30 wt % of pigments and fillers combined, about 10 to about 20 wt % water, about 0.01 to about 5 wt % of one or more surfactants, and about 1 to about 3 wt % tourmaline.

Ceramic-containing resins used in accordance with various aspects of the present disclosure can include any suitable ceramic and any suitable resin. In some instances, the ceramic of the ceramic-containing resin can be any one of silicon carbide, aluminum nitride, silicon nitride, alumina ($Al_2O_3$), beryllium oxide (BeO), boron nitride (BN), and titania ($TiO_2$). The resin of the ceramic-containing resin can be any suitable resin including, but not limited to, a polyphenylene sulfide (PPS) resin having a mass average molecular weight (Mw) of 35,000 or more, a silicon-carboxyl resin, a monoaluminum phosphate resin, an alumina silicate resin, a silicone epoxy resin, a polyamide resin, a polysilazane resin such as a perhydropolysilazane, a methylhydridocyclosilazane, an alkylhydridocyclosilazane, and a polyureidosilazane, a polysiloxane, a polyalkylsilsesquioxane resin; such as a polymethylsilsesquioxane, a polyvinylsilsequioxane, and a polyphenylsilsesquioxane, a polyphosphazine, a polyborosilane, a polycarbosilazane, a methylpolycarbosilane, a vinylpolycarbosilane, a methylvinylpolycarbosilane, a polytitanocarbosilane, an allyl hydridopolycarbosilane, a hydridopolycarbosilane, a ureamethylvinylsilazane, a polyvinylsiloxane, a polymethylsiloxane, a polydimethylsiloxane, a polycarbosilane, variants, derivatives and combinations thereof.

The one or more color pigments of the ceramic oil can be any suitable pigments. The pigments can be used to impart the ceramic oil and subsequently formed lava rock coating with a desired color such as, for example, a shade of red, a shade of green, a shade of blue, a shade of orange, a shade of yellow, a shade of indigo, a shade of violet, etc.

After addition of the lava rock to the oil, the resulting mixture can comprise between about 0.1 wt % to about 25 wt % lava rock and about 75 wt % to about 99.9 wt % ceramic oil, alternatively about 0.5 wt % to about 20 wt % lava rock and about 80 wt % to about 99.5 wt % ceramic oil, alternatively about 1 wt % to about 15 wt % lava rock and about 85 wt % to about 99 wt % ceramic oil, alternatively about 1.5 wt % to about 10 wt % lava rock and about 80 wt % to about 99.5 wt % ceramic oil, alternatively about 2 wt % to about 5 wt % lava rock and about 95 wt % to about 98 wt % ceramic oil, and alternatively about 2.5 wt % to about 3.5 wt % lava rock and about 96.5 wt % to about 97.5 wt % ceramic oil. In some instances, the resulting mixture can comprise about 3 wt % lava rock and about 97 wt % ceramic oil.

In block 303, the lava rock-containing ceramic oil is mixed for a period of time sufficient to ensure homogenization. Mixing in block 303 can take place for a period of time ranging from about 15 minutes to about 5 hours, alternatively from about 30 minutes to about 4 hours, alternatively from about 1 hour to about 3 hours, and alternatively about 2 hours. In some instances, mixing is performed using a mechanical mixing apparatus fitted with an impeller. When mixing with a mechanical mixing apparatus, the impeller can rotate in the lava rock-containing oil at a rate ranging from about 25 rpm to about 500 rpm, alternatively about 50 rpm to about 400 rpm, alternatively about 75 rpm to about 300 rpm, alternatively about 75 rpm to about 200 rpm, and alternatively about 75 rpm to about 150 rpm. In some instances, mixing of the lava rock-containing oil can be accomplished by ultrasonication using an ultrasonic bath or an ultrasonic probe. In other instances, mixing of the lava rock-containing oil can be accomplished by shaking or agitation. In general, mixing is performed at room temperature. Mixing in block 303, however, can be performed at any temperature below the boiling point of the oil.

In block 304, the homogenized lava rock-containing oil from block 303 is placed in a cylindrical vessel and the vessel is sealed. The cylindrical vessel is then rolled along the longitudinal axis of the sealed cylinder for a period of time sufficient to allow the powdered lava rock to dissolve in, and react with, the oil. Rolling in block 304 can take place for a period of time ranging from about 4 hours to about 48 hours, alternatively from about 6 hours to about 36 hours, alternatively from about 8 hours to about 24 hours, alternatively from about 10 hours to about 16 hours, and alternatively about 12 hours. Rolling in block 304 can be performed at a rate ranging from about 25 rpm to about 500 rpm, alternatively about 50 rpm to about 450 rpm, alternatively about 75 rpm to about 400 rpm, alternatively about 100 rpm to about 350 rpm, alternatively about 150 rpm to about 350 rpm and alternatively about 200 rpm to about 300 rpm. In general, rolling is performed at room temperature. Rolling in block 304, however, can be performed at any temperature below the boiling point of the oil.

In block 305, undissolved solids are removed from the rolled lava rock-containing ceramic oil of block 304 to obtain the final lava rock-containing ceramic oil product. In some instances, undissolved solids are removed from the rolled lava rock-containing ceramic oil of block 304 by a filtration procedure such as gravity filtration or vacuum filtration. In other instances, undissolved solids can be removed from the rolled lava rock-containing ceramic oil of block 304 by centrifugation and decantation steps. In yet other instances undissolved solids can be removed from the rolled lava rock-containing ceramic oil of block 304 by centrifugation and in a vessel having an openable port in a bottom portion of the vessel and opening the port to allow undissolved solids to exit therefrom.

Figure 4:
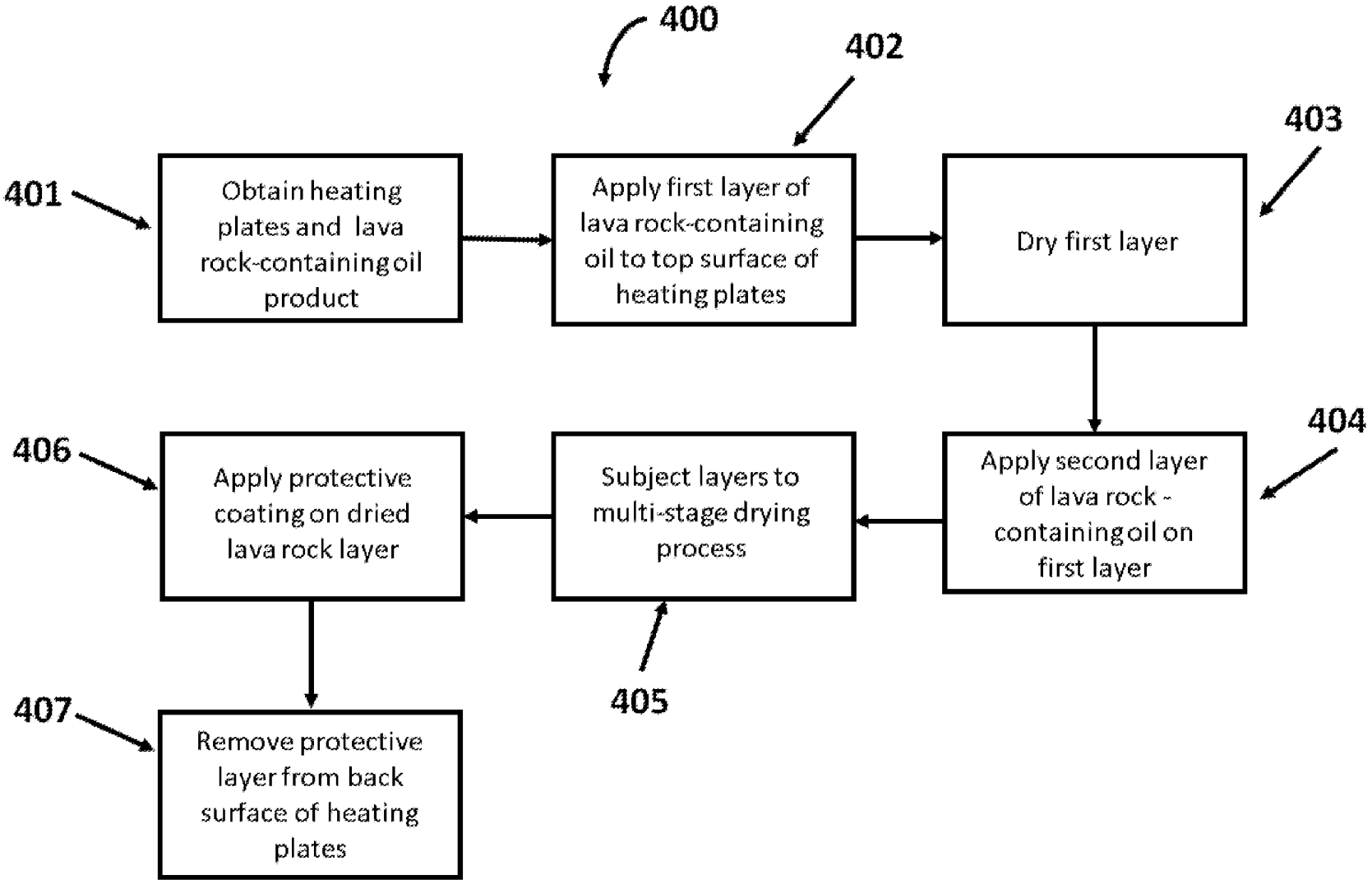
FIG. 4 is a flowchart illustrating an exemplary method of forming lava rock-coated heating plates for use in a hair styling flat iron in accordance with various aspects of the present disclosure.

FIG. 4 is a flow chart illustrating an exemplary method for preparing lava rock-coated heating plates. One of ordinary skill in the art will appreciate that one or more steps of the exemplary method 400 can be omitted, or one or more steps can be added to the exemplary method 400, without imparting from the scope of the present disclosure. The exemplary method 400 can start at block 401. In block 401, heating plates for use in a hairstyling flat iron, such as the flat iron 100, and the final lava rock-containing oil product from block 305 are obtained. In some instances, the heating plates are made of a metal such as aluminum, iron or copper. In other instances, the heating plates can be made of an alloy such as steel, brass, bronze, a Hastelloy® alloy such as a nickel-chromium-molybdenum-tungsten, nickel-chromium-molybdenum-tungsten-iron, nickel-chromium-cobalt, an Inconoly® alloy such as iron-nickel-chromium or iron-nickel-chromium, an austentic nickel-chromium-based alloy (Inconel), a nickel-copper alloy (Monel), or a cupronickel alloy. In yet other instances, the heating plates can be made of a porcelain or ceramic such as silicon carbide, aluminum nitride, silicon nitride, alumina ($Al_2O_3$), beryllium oxide (BeO), boron nitride (BN), and titania ($TiO_2$). The heating plates can be described as having a top surface which will be coated with the lava rock-containing oil product and a bottom surface which will not be coated with the lava rock-containing oil product.

In block 402, a first layer of the lava rock-containing ceramic oil product is applied to the top surface of the heating plates. In some instances, the lava rock-containing ceramic oil product is applied to the top surface of the heating plates via spray coating. In other instances, the lava rock-containing ceramic oil product can be applied to the top surface of the heating plates via brush coating. In yet other instances, the lava rock-containing ceramic oil product can be applied to the top surface of the heating plates via blade coating. In yet other instances, the lava rock-containing ceramic oil product can be applied to the top surface of the heating plates via spin coating. In yet other instances, the lava rock-containing ceramic oil product can be applied to the top surface of the heating plates via dip coating. In any of the above coating techniques, a protective layer, such as a tape or film, can first be applied to the back surface of the heating plates to prevent application of the lava rock-containing ceramic oil product to the back surface.

In block 403, the first layer of the lava rock-containing ceramic oil product is subjected to a brief drying period. The temperature of the brief drying period of block 403 can range from 60° C. to about 120° C., alternatively from about 70° C. to about 100° C., alternatively from about 75° C. to about 90° C., and alternatively about 80° C. The time for drying in block 403 can range from about 30 seconds to 10 minutes, alternatively about 1 minute to about 5 minutes, alternatively about 1 minute to about 3 minutes, and alternatively about 2 minutes.

In block 404, a second layer of the lava rock-containing ceramic oil product is applied onto the first layer. Application of the second layer of the lava rock-containing ceramic oil product in block 404 can be accomplished using the same procedure as in block 402.

In block 405, the heating plates, now coated with two layers of the lava rock-containing ceramic oil product, are subjected to a multi-stage drying process which comprises at least first stage and a second stage. The first drying stage can be conducted at a temperature ranging from about 100° C. to about 200° C., alternatively from about 110° C. to about 180° C., alternatively from about 120° C. to about 160° C., alternatively from about 120° C. to about 140° C., and alternatively about 130° C. The first drying stage can be conducted for a period of time ranging from about 5 minutes to about 1 hour, alternatively from about 10 minutes to about 45 minutes, alternatively from about 10 minutes to about 30 minutes, and alternatively about 15 minutes. The second drying stage can be conducted at a temperature ranging from about 200° C. to about 400° C., alternatively from about 210° C. to about 350° C., alternatively from about 220° C. to about 300° C., alternatively from about 230° C. to about 280° C., alternatively from about 240° C. to about 260° C., and alternatively about 250° C. The second drying stage can be conducted for a period of time ranging from about 30 minutes to about 4 hours, alternatively from about 45 minutes to about 3 hours, alternatively from about 1 hour to about 2 hours, and alternatively about 1.5 hours. In other instances, the first stage is conducted at a higher temperature than the second stage. After the multistage drying process is completed, the top surface of the heating plates will have a dried lava rock and ceramic-containing resin layer having a thickness ranging from about 5 micrometers (μm) to about 100 μm, alternatively from about 10 μm to about 75 μm, alternatively from about 15 μm to about 50 μm, alternatively from about 20 μm to about 40 μm, alternatively from about 20 μm to about 30 μm, and alternatively about 25 μm.

The layers applied in blocks 402 and 404 can be of the same thickness or of substantially the same thickness prior to drying. In some instances, the first layer can be applied in block 402 to have a larger thickness than the thickness of the second layer applied in block 404. In some instances, the first layer can be applied in block 402 to have a smaller thickness than the thickness of the second layer applied in block 404. In some instances, one or more of blocks 402-404 can be repeated prior to block 405.

In block 406, a protective coating can be applied to the dried lava rock and ceramic-containing layer. The protective layer serves to protect the underlying dried lava rock layer from the external environment and to provide a smooth surface for use when styling hair with the hairstyling flat iron. The protective coating can be made of any suitable material that is stable at operating temperatures of hairstyling flat irons in accordance with various aspects of the present disclosure. In some instances, the protective coating is made of silicon dioxide. In other instances, the protective coating can be made of a metal oxide such as titanium dioxide or aluminum oxide. The protective coating can be applied to have a thickness ranging from about 100 nm to about 50 μm, alternatively about 500 nm to about 40 μm, alternatively about 1 μm to about 30 μm, alternatively about 2.5 μm to about 20 μm, and alternatively about 5 μm to about 10 μm In block 407, the protective layer is removed from the back surface of the heating plates. If a protective layer is not added to the back surface of the heating plates, however, block 407 will be omitted from the exemplary method 400.

After the lava rock-coated heating plates are formed by a method, such as the exemplary method 400, they may be incorporated into a hairstyling iron, such as the hairstyling flat iron 100.

EXAMPLES

The Examples provided below are merely exemplary and should not be construed as limiting the appended claims in any way. Furthermore, one of ordinary skill in the art will appreciate that certain preparative variables or experimental parameters may be modified without imparting from the scope of the examples or the subject matter described in the present disclosure.

Example 1—Preparation of Composition

A basalt was ground into a fine powder consisting of basalt granules ranging from 10 nm to 5 μm. 32.3 g of the fine powder basalt was added to 1064 g of ceramic oil (Dongguan LilaTu Chemical Co., Ltd.) to form a mixture having about 3 wt % basalt and about 97 wt % ceramic oil. The mixture was then mixed at room temperature using a Mixmaster Machine fitted with an impeller at 75-150 rpm for about 2 hours to ensure infusion of the fine powder basalt into the ceramic oil. The mixture was then placed in a cylindrical plastic drum. The drum was sealed and rolled at 200-300 rpm for 12 hours at room temperature. After rolling, the mixture was subjected to gravity filtration through a polyester cloth (350 mesh) to remove undissolved solids, yielding the final basalt-containing ceramic oil.

Example 2—Preparation of Heating Plate from Composition of Example 1

The basalt-containing ceramic oil was applied to a top surface of two aluminum plates by spray coating. A first spray coating was applied and the aluminum plates with the first spray coating were dried at 80° C. for 2 minutes. A second spray coating was then applied followed by drying at 130° C. for 15 minutes and further drying at 250° C. for 1.5 hours. After the multistage drying process, the aluminum plates had a basalt-containing ceramic coating having a thickness of about 25 micrometers (μm). Silicon dioxide was then applied to the basalt-containing ceramic coating to form a 5-10 μm protective coating.

Examples 3-5

Examples 3-5 below provide data for various tests comparing a hairstyling flat iron having the heating plates of Example 2 (hereinafter "lava rock flat iron") to two commercially available comparative hairstyling flat irons. The first comparative flat iron is a CHI® flat iron having ceramic-coated heating plates heated to a temperature of 200° C. (comparative flat iron #1). The second comparative flat iron is a CHI® flat iron having ceramic-coated heating plates heated to a temperature of 220° C. (CHI® flat iron #2). The results for Examples 3-5 are compiled in Table 1.

Example 3—Comparison of Heat Up Time

In Example 3, the stable temperature of the heating plates of each flat iron was measured after a 30 minute heat up cycle. The heating plates were at room temperature at the beginning of each test. The average amount of time required for the heating plates of each iron to reach a temperature equivalent to 90% of the stable temperature was also measured.

The lava rock flat iron attained an average stable temperature of 197° C. The lava rock flat iron required an average of 23 seconds to reach a temperature equivalent to 90% of the maximum stable temperature.

Comparative flat iron #1 also attained an average stable temperature of 197° C. Comparative flat iron #1 required an average of 31 seconds to reach a temperature equivalent to 90% of the maximum stable temperature.

Comparative flat iron #2 attained an average stable temperature of 220° C. Comparative flat iron #2 required an average of 32 seconds to reach a temperature equivalent to 90% of the maximum stable temperature.

TABLE 1

Compilation of Data from Examples 3-5.

| | Lava Rock Flat Iron | | | Comparative Flat Iron #1 (Temp. 200° C.) | | Comparative Flat Iron #2 (Temp. 220° C.) | | |
|---|---|---|---|---|---|---|---|---|
| Trial | 1 | 2 | 3 | 1 | 2 | 1 | 2 | 3 |
| Stable temp. (° C.) after 30 min heat cycle | 203 | 195 | 194 | 198 | 196 | 221 | 218 | 220 |
| Average Temp. (° C.) | | 197 | | 197 | | | 220 | |
| Time (s) to reach 90% of stable temp. | 23 | 22 | 23 | 31 | 30 | 33 | 29 | 33 |
| Average Time (s) | | 23 | | 31 | | | 32 | |
| Temp (° C.) after damp towel test | 135 | 145 | 140 | 112 | 115 | 112 | 109 | 118 |
| ΔT (% loss) | 68 (33%) | 50 (26%) | 54 (28%) | 86 (43%) | 81 (41%) | 109 (49%) | 109 (50%) | 102 (46%) |
| Average temp. after damp towel test | | 140 | | 114 | | | 113 | |
| Average ΔT (% loss) | | 57 (29%) | | 84 (42%) | | | 107 (49%) | |
| Recovery Time (s) to stable temp. | 9 | 8 | 9 | 13 | 12 | 11 | 13 | 13 |
| Average Recovery Time (s) | | 9 | | 13 | | | 12 | |

The above data indicates that the lava rock flat iron according to the present disclosure reaches average stable temperatures competitive with commercially available flat irons and reaches temperature equivalent to 90% of the stable temperature in 8 to 9 less seconds. Accordingly the lava rock flat iron heats to 90% of the stable temperature at a rate 26-28% faster than other commercially available flat irons.

Example 4—Comparison of Temperature Reduction

In Example 4, the temperature reduction of each flat iron was evaluated by pressing the heating plates of the flat iron on a damp towel and pulling the damp towel therefrom. After the pressing and pulling had been performed twenty (20) times, the temperature of the flat iron was measured. For simplicity, this test is referred to below as the damp towel test.

The lava rock flat iron had an average temperature of 197° C. prior to beginning the damp towel test. After the damp towel test, the measured average temperature of the lava rock flat iron was 140° C., constituting an average temperature reduction of 29%.

Comparative flat iron #1 had an average temperature of 197° C. prior to beginning the damp towel test. After the damp towel test, the measured average temperature of comparative flat iron #1 was 114° C., constituting an average temperature reduction of 42%.

Comparative flat iron #1 had an average temperature of 220° C. prior to beginning the damp towel test. After the damp towel test, the measured average temperature of comparative flat iron #1 was 113° C., constituting an average temperature reduction of 49%.

As can be seen, the lava rock flat iron is substantially more effective at retaining heat than other commercially available flat irons.

Example 5—Comparison of Heat Up Time after Temperature Reduction

In Example 5, the amount of time required for each hairstyling flat iron to reach its stable temperature (Example 3) from temperature at the end of the damp towel test (Example 4) was measured.

The lava rock flat iron required an average of 9 seconds to reach its stable temperature from temperature at the end of the damp towel test. Comparative flat iron #1 required an average of 13 seconds to reach its stable temperature from temperature at the end of the damp towel test. Comparative flat iron #2 required an average of 12 seconds to reach its stable temperature from temperature at the end of the damp towel test.

From the above, it is shown that not only does the lava rock flat iron retain heat better than other commercially available flat irons but also reheats 25-31% faster than other commercially available flat irons during use.

STATEMENTS OF THE DISCLOSURE

Statements of the Disclosure include:

Statement 1: A hair styling flat iron, the flat iron comprising a first arm comprising a first gripping portion and a first styling portion; a second arm comprising a second gripping portion and a second styling portion; a pivotable member coupled with the first gripping portion of the first arm and the second gripping portion of the second arm to move the second arm away from and towards the first arm; a first heating plate located on a surface of the first styling portion facing the second arm, the first heating plate comprising a first heat transmissive plate and a first coating disposed on the first heat transmissive plate, the first coating having ceramic and lava rock incorporated therein; and a second heating plate located on a surface of the second styling portion facing the first arm, the second heating plate comprising a second heat transmissive plate and a second coating disposed on the second heat transmissive plate, the second coating having ceramic and lava rock incorporated therein.

Statement 2: A flat iron according to Statement 1, further comprising an electrical cord electrically couplable with an external electricity source.

Statement 3: A flat iron according to Statement 1 or 2, wherein the lava rock of one or more of the first coating and the second coating is selected from the group consisting of ultramafic rock, mafic rock, intermediate rock, intermediate-felsic rock, and felsic rock.

Statement 4: A flat iron according to any one of Statements 1-3, wherein the lava rock of one or more of the first coating and the second coating is selected from the group consisting of komatiite, picrite basalt, basalt, basaltic andesite, andesite, dacite, rhyolite, nephelinite, melilitite, tephrite, basanite, trachybasalt, basaltic trachyandesite, trachyandesite, trachite, trachydacite, phonotephrite, tephriphonolite, phonolite, scoria, tuff, latite pumice, and ignimbrite.

Statement 5: A flat iron according to any one of Statements 1-4, wherein the lava rock of one or more of the first coating and the second coating is basalt.

Statement 6: A flat iron according to any one of Statements 1-5, wherein the lava rock of one or more of the first coating and the second coating is in the form of particulates, the particulates having diameters ranging from about 10 nm to about 25 μm.

Statement 7: A flat iron according to any one of Statements 1-6, wherein each of the first coating and the second coating have a thickness ranging from about 5 micrometers (μm) to about 100 μm.

Statement 8: A flat iron according to any one of Statements 1-7, wherein each of the first coating and the second coating have a thickness ranging from about 20 micrometers (μm) to about 30 μm.

Statement 9: A flat iron according to any one of Statements 1-8, further comprising a first protective coating disposed on the first coating; and a second protective coating disposed on the second coating.

Statement 10: A flat iron according to Statement 9, wherein each of the first protective coating and the second protective coating comprise silicon dioxide.

Statement 11: A flat iron according to Statement 9 or 10, wherein each of the first protective coating and the second protective coating have a thickness ranging from about 100 nm to about 50 μm.

Statement 12: A flat iron, the flat iron comprising a gripping portion; a styling portion; and a heating plate located on a surface of the styling portion, the heating plate comprising a heat transmissive plate and a coating disposed on the heat transmissive plate, the coating having ceramic and lava rock incorporated therein.

Statement 13: A flat iron according to Statement 12, further comprising an electrical cord electrically couplable with an external electricity source.

Statement 14: A flat iron according to Statement 12 or 13, wherein the lava rock of the coating is selected from the group consisting of ultramafic rock, mafic rock, intermediate rock, intermediate-felsic rock, and felsic rock.

Statement 15: A flat iron according to any one of Statements 12-14, wherein the lava rock of the coating is selected from the group consisting of komatiite, picrite basalt, basalt, basaltic andesite, dacite, rhyolite, nephelinite, melilitite, tephrite, basanite, trachybasalt, basaltic trachyandesite, trachyandesite, trachite, trachydacite, phonotephrite, tephriphonolite, phonolite, scoria, tuff, latite pumice, and ignimbrite.

Statement 16: A flat iron according to any one of Statements 12-15, wherein the lava rock of the coating is basalt.

Statement 17: A flat iron according to any one of Statements 12-16, wherein the lava rock of the coating is in the form of particulates, the particulates having diameters ranging from about 10 nm to about 25 μm.

Statement 18: A flat iron according to any one of Statements 12-17, wherein the coating has a thickness ranging from about 5 micrometers (μm) to about 100 μm.

Statement 19: A flat iron according to any one of Statements 12-18, wherein the coating has a thickness ranging from about 20 micrometers (μm) to about 30 μm.

Statement 20: A flat iron according to any one of Statements 12-19, further comprising a protective coating disposed on the coating.

Statement 21: A flat iron according to Statement 20, wherein the protective coating comprises silicon dioxide.

Statement 22: A flat iron according to Statement 20 or 21, wherein the protective coating has a thickness ranging from about 100 nm to about 50 μm.

Although the present invention and its objects, features and advantages have been described in detail, other embodiments are encompassed by the invention. Finally, those skilled in the art should appreciate that they can readily use the disclosed conception and specific embodiments as a basis for designing or modifying other structures for carrying out the same purposes of the present invention without departing from the scope of the invention as defined by the appended claims.

What is claimed is:

1. A hair styling flat iron, the flat iron comprising:

a first arm comprising a first gripping portion and a first styling portion;

a second arm comprising a second gripping portion and a second styling portion;

a pivotable member coupled with the first gripping portion of the first arm and the second gripping portion of the second arm to move the second arm away from and towards the first arm;

a first heating plate located on a surface of the first styling portion facing the second arm, the first heating plate comprising a first heat transmissive plate and a first coating disposed on the first heat transmissive plate, the first coating having a ceramic and a rock incorporated therein; and a second heating plate located on a surface of the second styling portion facing the first arm, the second heating plate comprising a second heat transmissive plate and a second coating disposed on the second heat transmissive plate, the second coating having a ceramic and a lava rock incorporated therein.

2. The flat iron of claim 1, further comprising an electrical cord electrically couplable with an external electricity source.

3. The flat iron of claim 1, wherein the lava rock of one or more of the first coating and the second coating is selected from the group consisting of ultramafic rock, mafic rock, intermediate rock, intermediate-felsic rock, and felsic rock.

4. The flat iron of claim 3, wherein the lava rock of one or more of the first coating and the second coating is basalt.

5. The flat iron of claim 1, wherein the lava rock of one or more of the first coating and the second coating is selected from the group consisting of komatiite, picrite basalt, basalt, basaltic andesite, andesite, dacite, rhyolite, nephelinite, melilitite, tephrite, basanite, trachybasalt, basaltic trachyandesite, trachyandesite, trachite, trachydacite, phonotephrite, tephriphonolite, phonolite, scoria, tuff, latite pumice, and ignimbrite.

6. The flat iron of claim 1, wherein the lava rock of one or more of the first coating and the second coating is in the form of particulates, the particulates having diameters ranging from about 10 nm to about 25 μm.

7. The flat iron of claim 1, wherein each of the first coating and the second coating have a thickness ranging from about 5 micrometers (μm) to about 100 μm.

8. The flat iron of claim 1, wherein each of the first coating and the second coating have a thickness ranging from about 20 micrometers (μm) to about 30 μm.

9. The flat iron of claim 1, further comprising:

a first protective coating disposed on the first coating; and a second protective coating disposed on the second coating.

10. The flat iron of claim 9, wherein each of the first protective coating and the second protective coating comprise silicon dioxide.

11. The flat iron of claim 9, wherein each of the first protective coating and the second protective coating have a thickness ranging from about 100 nm to about 50 μm.

12. A flat iron, the flat iron comprising:

a gripping portion;

a styling portion; and a heating plate located on a surface of the styling portion, the heating plate comprising a heat transmissive plate and a coating disposed on the heat transmissive plate, the coating having a ceramic and a lava rock incorporated therein.

13. The flat iron of claim 12, further comprising an electrical cord electrically couplable with an external electricity source.

14. The flat iron of claim 12, wherein the lava rock of the coating is selected from the group consisting of ultramafic rock, mafic rock, intermediate rock, intermediate-felsic rock, and felsic rock.

15. The flat iron of claim 12, wherein the lava rock of the coating is selected from the group consisting of komatiite, picrite basalt, basalt, basaltic andesite, andesite, dacite, rhyolite, nephelinite, melilitite, tephrite, basanite, trachybasalt, basaltic trachyandesite, trachyandesite, trachite, trachydacite, phonotephrite, tephriphonolite, phonolite, scoria, tuff, latite pumice, and ignimbrite.

16. The flat iron of claim 15, wherein the lava rock of the coating is basalt.

17. The flat iron of claim 12, wherein the lava rock of the coating is in the form of particulates, the particulates having diameters ranging from about 10 nm to about 25 μm.

18. The flat iron of claim 12, wherein the coating has a thickness ranging from about 5 micrometers (μm) to about 100 μm.

19. The flat iron of claim 12, wherein the coating has a thickness ranging from about 20 micrometers (μm) to about 30 μm.

20. The flat iron of claim 12, further comprising a protective coating disposed on the coating.

21. The flat iron of claim 20, wherein the protective coating comprises silicon dioxide.

22. The flat iron of claim 20, wherein the protective coating has a thickness ranging from about 100 nm to about 50 μm.

* * * * *